US005758937A

United States Patent [19]

Lammens et al.

[11] Patent Number: 5,758,937

[45] Date of Patent: Jun. 2, 1998

[54] BRAKING MECHANISM FOR OVER-TOP FLIPPER DOOR SLIDE SYSTEM

[75] Inventors: Arthur E. Lammens, Fullerton; Victor H. Ayala, Pico Rivera, both of Calif.

[73] Assignee: Accuride International, Inc., Santa Fe Springs, Calif.

[21] Appl. No.: 781,614

[22] Filed: Jan. 9, 1997

Related U.S. Application Data

[63] Continuation of Ser. No. 520,952, Aug. 30, 1995, abandoned.

[51] Int. Cl.[6] ..... A47B 88/00

[52] U.S. Cl. ..... 312/328; 312/323; 312/329; 16/84; 49/254; 49/386

[58] Field of Search ..... 16/362, 364, 319, 16/84; 312/328, 226, 327, 329, 322, 323; 49/254, 386, 197; 188/271, 129; 267/196, 201

[56] References Cited

U.S. PATENT DOCUMENTS

| | | | |
|---|---|---|---|
| Re. 28,994 | 10/1976 | Aylworth . | |
| 890,207 | 6/1908 | Anderson . | |
| 2,652,305 | 9/1953 | Swedman et al. . | |
| 2,774,644 | 12/1956 | Patterson . | |
| 3,464,161 | 9/1969 | Jonsson | 49/197 |
| 3,679,275 | 7/1972 | Fahl et al. . | |
| 3,703,325 | 11/1972 | Schnarr . | |
| 3,722,964 | 3/1973 | Chitester et al. . | |
| 3,825,215 | 7/1974 | Borglum | 16/84 X |
| 3,912,341 | 10/1975 | Stein . | |
| 4,516,813 | 5/1985 | Sekerich | 312/323 |
| 4,600,254 | 7/1986 | Whalen . | |
| 4,615,570 | 10/1986 | Goodman . | |
| 4,620,743 | 11/1986 | Eke | 16/364 X |
| 4,662,690 | 5/1987 | Genereaux . | |
| 4,729,612 | 3/1988 | Stone . | |
| 4,926,982 | 5/1990 | Granbom | 188/271 |
| 4,974,912 | 12/1990 | Rask et al. . | |
| 5,037,163 | 8/1991 | Hatcher . | |
| 5,203,114 | 4/1993 | Orlando | 49/386 |
| 5,399,010 | 3/1995 | McClung et al. . | |
| 5,409,308 | 4/1995 | Reuter et al. . | |
| 5,465,862 | 11/1995 | Devlin | 49/386 X |

FOREIGN PATENT DOCUMENTS

| | | | |
|---|---|---|---|
| 2349078 | 4/1975 | Germany | 16/84 |
| 2915962 | 11/1980 | Germany | 16/319 |

OTHER PUBLICATIONS

Sugatsune Kogyo Co. Ltd., Over–The–Top Type Receding and Soft Closing Mechanism Flipper Door by Rotary Damper and Slides, two–page brochure.

*Primary Examiner*—Peter M. Cuomo
*Assistant Examiner*—Hanh V. Tran
*Attorney, Agent, or Firm*—Christie, Parker & Hale, LLP

[57] ABSTRACT

A self braking door slide mechanism particularly adapted for use with cabinets that have front doors that open upwardly and are retracted using the slide mechanism to a position in which the door is aligned with the top of the cabinet in either an over or under top position. A dampening cylinder extends between the top of the cabinet and the door to slow its downwardly hinging action when the door is being closed. Auxiliary brake pads are also provided on a stationary slide member which bear against the moving portion of the slide mechanism to slow the sliding action during closing due to the force of the dampening cylinder.

20 Claims, 3 Drawing Sheets

BRAKING MECHANISM FOR OVER-TOP FLIPPER DOOR SLIDE SYSTEM

CROSS-REFERENCE TO RELATED APPLICATION

This is a continuation of application Ser. No. 08/520,952, filed Aug. 30, 1995 now abandoned.

BACKGROUND OF THE INVENTION

This invention relates to an improvement in wall-mounted cabinets of the type employed in offices, laboratories and the like. In one type of prior art wall cabinet with a stored door feature, the door generally slides to a stored position above the cabinet itself. Other prior art cabinets also utilize this feature and in these embodiments the door slides into a stored position inside the cabinet, either at the top or at the side of the cabinet. The cabinet doors of the over the top variety have a drawback in that when the door is slid forward to close the enclosure, the weight of the door tends to cause the door to accelerate and swing rapidly downwardly and slide forwardly at the same time creating the possibility of striking the person who is attempting to close the cabinet causing pain and possible injury.

SUMMARY OF THE INVENTION

The over the cabinet door assembly of this invention is significantly superior to prior art cabinets in that the door of the cabinet is equipped in such a way as to allow the door to be easily raised and moved to a stored position while requiring minimal effort at any point during movement along the path of closure. The assembly also has the added feature that the hardware is mostly hidden from view when it is in the stored position. When the door is moved forward to bring it to the closed position, a dampening mechanism is provided which extends between the enclosure and the door to retard and slow the door in its forward sliding motion and downward rotation motion to the closed position.

The foregoing is accomplished in accordance with the present invention, by providing an enclosure having a door which is slidably and hingedly retractable from a closed to an open position. The door comprises at least one ball bearing slide mechanism attached to the interior side of the door and a hinge mechanism attached at one side to the enclosure and to the slide mechanism at the end of the slide mechanism adjacent to the top of the enclosure. A motion dampening mechanism extends between the slide and the underside of the cabinet whereby the closing movement motion of the door is substantially retarded and slowed by the dampening mechanism as it swings and slides downwardly and rotates toward the enclosure.

BRIEF DESCRIPTION OF THE DRAWING

Many of the intended advantages of the present invention would be more readily apparent and better understood as the following detailed description is considered in connection with the accompanying drawing in which.

DESCRIPTION OF THE PREFERRED EMBODIMENT

Figure 1:
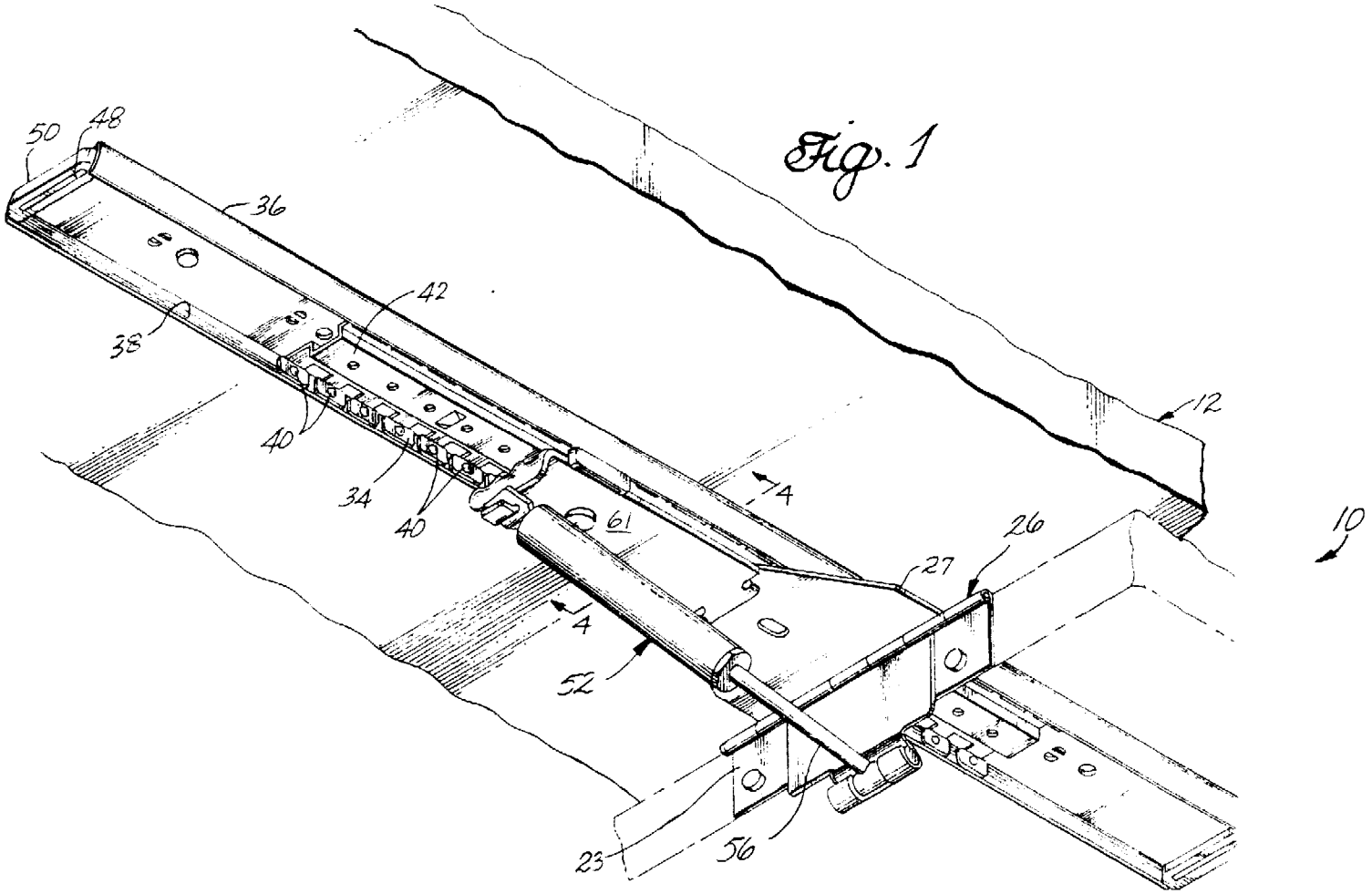
FIG. 1 is a perspective view of a portion of an enclosure door and slide mechanism and attendant dampening mechanism according to the present invention in the raised position before being slid over the top of the enclosure to the open position.
Figure 2B:
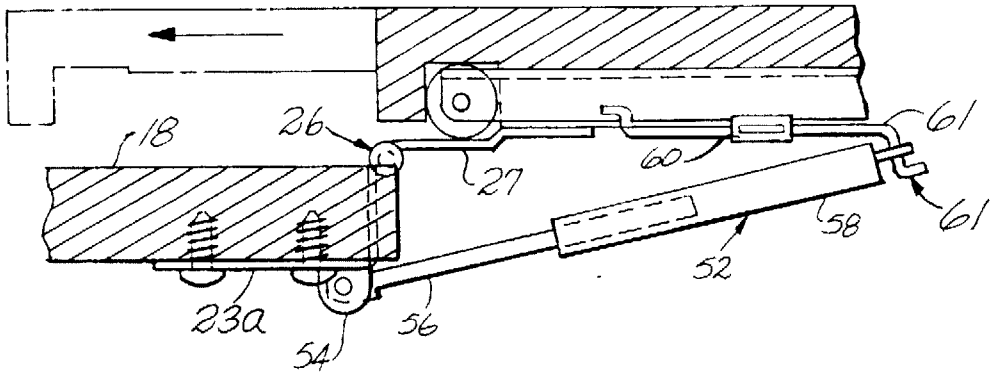
FIG. 2B is a sectional view of the door slide with dampening mechanism in the open door position.
Figure 4:
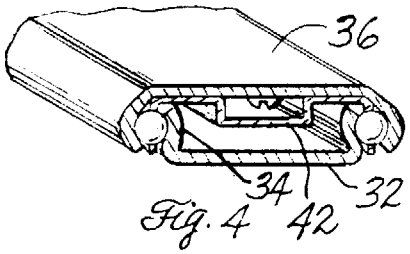
FIG. 4 is a sectional view of the slide mechanism taken along lines 4—4 of FIG. 1.
Figure 2A:
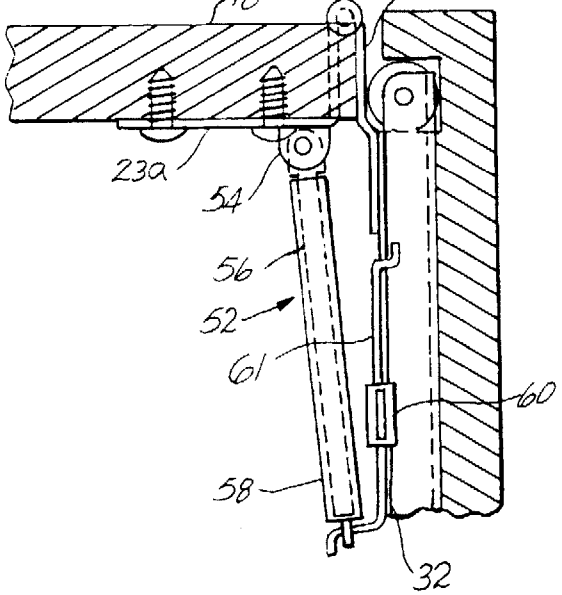
FIG. 2A is a sectional view of the door slide with dampening mechanism in the closed door position.
Figure 3:
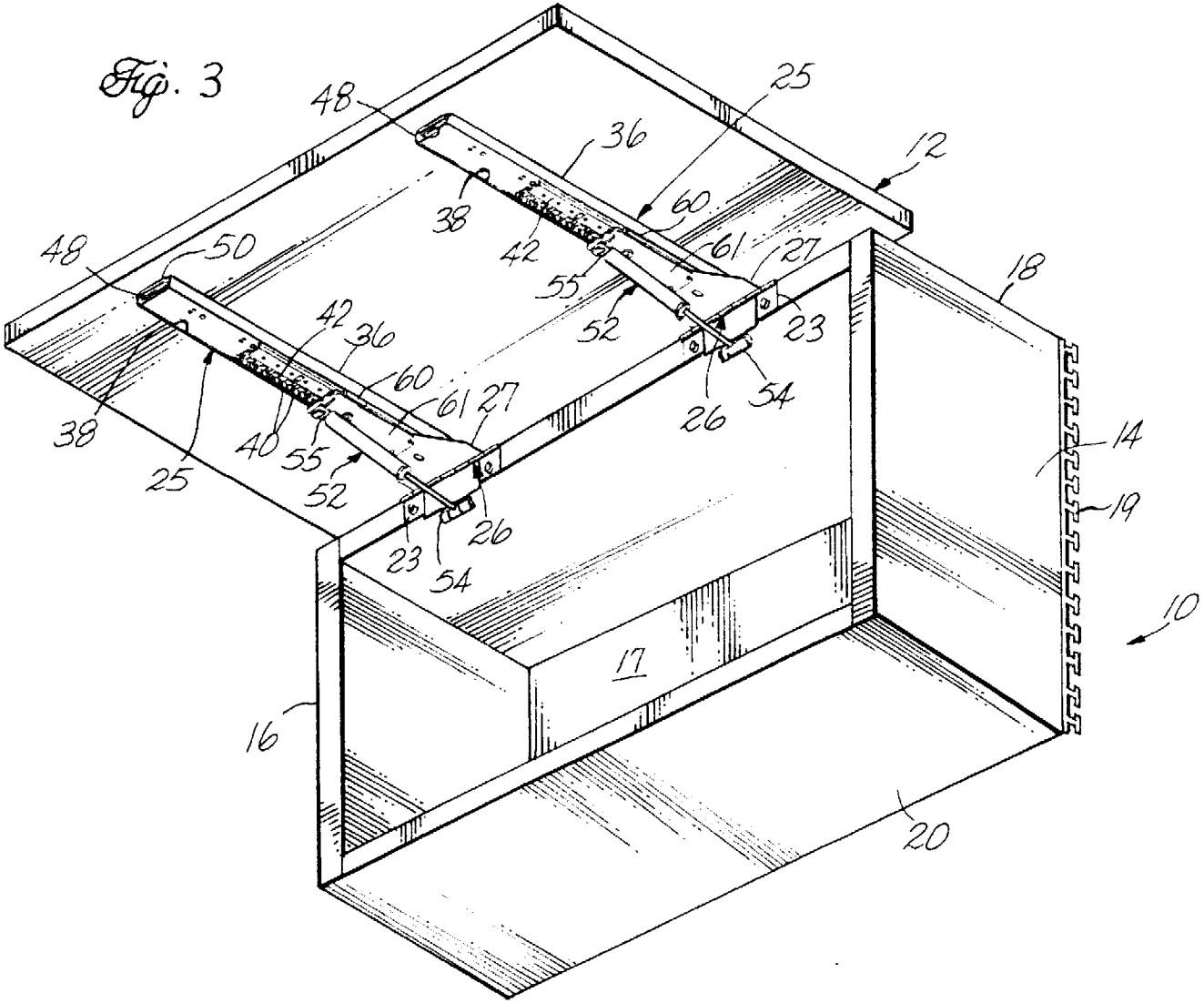
FIG. 3 is a perspective view of an enclosure according to the present invention wherein the door is equipped with the pair of slide mechanisms and a pair of dampening mechanisms to enable the door to be opened and slid over the top of the enclosure to the fully open position.

In FIGS. 1 to 3 as shown, a cabinet or enclosure according to the present invention generally designated 10 with the door 12 in the closed and partially open positions. The cabinet includes a pair of side walls 14 and 16 to which a top wall 18 and a bottom wall 20 are secured in any convenient well known fashion such as by screws, bolts, dowels, etc. The pair of side walls 14 and 16 and the top and bottom walls 18 and 20 form a rectangular cabinet to which door 12 is fixed and for which door 12 serves as a closure. Bracket means are provided at the rearward edges of each of the side walls to mount the enclosure to a wall or space dividing panel.

Any conventional mounting means may be employed with the cabinet and in one embodiment, mounting brackets 19 which include a plurality of T-shaped hooks which are compatible with conventional slotted standards employed in many modern modular space dividing systems are provided and are particularly suitable. Such space dividing systems are available from a number of manufacturers including Herman Miller and Steelcase. The cabinet may be provided with a back 17 or it may be backless when it is unnecessary for the cabinet itself to have its own rear wall.

The door member or closure 12 is affixed to the remainder of the cabinet by one or more hinge members 26 and slide mechanisms 25. Each of the hinge members 26 includes a plate 23 secured to the front edge of the top wall 18 and a second plate 27 that is secured to a stationary inner track member 32 which carries an inner ball bearing race 34. In an alternative embodiment shown in FIGS. 2A and 2B, an angle bracket 23 a is secured under top wall 18 and extends upwardly along the front edge to a hinge member 26 which is located in the same position as shown in FIG. 1. An outer movable track or channel member 36 is attached to the interior side or backside of the door 12 and extends for substantially the full height of the door as is best seen in FIG. 3. The outer movable track member 36 includes an outer ball bearing race 38. A plurality of ball bearings 40 are carried on a moving ball carriage 42 which locates the balls 40 between the inner race 34 and outer race 38. In the preferred embodiment, the length of moving ball carriage 42 is significantly greater than the length of its associated stationary inner track member 32. Furthermore, the stationary inner track member is shorter in length than either of the moving ball carriage 42 or the outer movable track member 36. The outer movable track members extend for substantially the full height of the door 12. This multi-track feature allows the door member to move in almost frictionless fashion from the closed position of FIG. 2A to the open position of FIG. 2B with little effort on the part of the person opening the cabinet. A pair of spaced hinge members 26 and slide mechanisms 25 (FIG. 3) allow the cabinet door to be raised and moved to a stored position by grasping the door at any point along the door bottom. The double track system provides for almost frictionless relative movement between the stationary track and the moving track through the multiple speed effect provided by the movable ball carriage.

The movable ball carriage moves with respect to the fixed track at a first speed and the rotation of the balls doubles that speed in imparting movement to the movable track and hence door 12. A pair of stop flanges are formed on the underside of the inner stationary track member 32 which co-acts with a pair of raised stop members on the upper side of the ball carriage 42 to prevent the stationary track member from being overrun by the ends of the ball carriage. At each end of the fixed outer track member 36 is a raised stop or end 48 which has mounted on it a bumper 50 which serves to cushion the impact when either the end of the inner track member or the ball carriage reaches the end of its travel against the stop 48.

The present invention provides a dampening mechanism 52 which is attached to the underside of the cabinet at one end 54 and at its opposite end 55 to a hinged brake plate 61 attached to the stationary track member 32. The dampening mechanism is typically a fluid containing cylinder and piston or slide mechanism and can be any one of a number of products which are available from companies which make products referred to variously as gas cylinders, gas springs, dampers, damper cylinders, linear decelerators, non-cavitating dampers, adjustable velocity control mechanisms and hydraulic check cylinders. Manufacturers of such equipment include Ace Controls Inc., Farmington, Mich.; Deschnar Corporation, Santa Ana, Calif., AVM (Arvin), Marion, S.C., Stabilus Corp., Colmar, Pa.; Enidine, Orchard Park, N.Y.; and Camloc Co., Madison Heights, Mich. A non-cavitating damper such as manufactured by AVM is particularly suitable for this application.

As best seen in FIG. 2A with the door in the closed position, the dampening mechanism 52 is in its fully closed position with the piston 56 shown in ghosted representation in FIG. 2A retracted for its full length to the bottom of the cylinder 58. When the door is opened, the cylinder, being attached at its end adjacent the door to the slide mechanism, is extended, drawing the cylinder outwardly over the piston. This action of opening movement continues until the door has rotated approximately 90° to the horizontal position shown in FIG. 2B. As shown therein, the cylinder has now extended approximately half again as long as its original length from the end of the piston, and the entire dampening mechanism has likewise rotated approximately 90° from a position in FIG. 2A where the mechanism is nearly vertical to a position in FIG. 2B where it has moved past the horizontal.

When the door is in the position shown in FIG. 2B, it is then moved in the direction of the arrow toward the rear of the enclosure under the control of the user until the door has moved to the point where the slide is in the fully closed position while the dampening mechanism is in the fully extended position. In this position the door overlies the top of the enclosure and the front edge of the door extends a predetermined distance in front of the leading edge of the sidewalls, top and bottom of the enclosure corresponding to the length of the extended cylinder.

In closing the door, the dampening mechanism comes into full play as the door is slid forward and reaches a point where its center of gravity passes the leading edge of the enclosure. At this point, the weight of the door causes it to hinge downwardly and begin to slide forward on the slide mechanism. As the door is allowed to rotate toward the closed position, the weight of the door bears on the cylinder and piston dampening mechanism 52 and the dampening action takes place, slowing the rotation of the door at a rate controlled by the rate of deceleration determined by the specific rating of the dampening mechanism.

The action of the weight of the door on the cylinder causes an equal and opposite reaction and the dampening mechanism exerts a force against the brake plate 61 causing it to hinge forward and exert a braking action on the movable outer member of the slide mechanism. A brake pad 60 is provided on each side of the brake plate which makes frictional contact with the edges of the moving channel member 36 and produces braking action on the edges of member 36.

The brake pad members 60 are chosen of a material with a high coefficient of friction such that the downward sliding action of the slide mechanism is retarded by the frictional braking force exerted by the brake pads on the sliding channel member 36.

The cooperative action of the dampening mechanism and the auxiliary brake pads caused the door to slowly slide forward and slowly rotate toward the closed position at a controlled rate such that there is no free fall or rapid closure of the door. This eliminates a rapid movement of the door which frequently results in striking the user on the head or slamming shut on the hand of the user.

As will be apparent from the foregoing, the cabinet door slide and dampening mechanism of the present invention provides a simple and efficient means for providing an easily opened, easily closed cabinet with a much improved performance and elimination of the annoyance of the tendency of the door to slam or fall shut.

What is claimed is:

1. A braking mechanism for a cabinet which has a top and a door which opens and closes from the top of the cabinet, the door having an interior side facing the cabinet comprising:

a hinge mechanism adapted to extend between the top of the cabinet and the door, the hinge mechanism comprising a hinge, a cabinet plate on one side of the hinge and a door plate on the opposite side of the hinge;

a slide mechanism adapted to attach to the underside of the door, the slide mechanism having a stationary member and a moving member, with the stationary member secured to the door plate; and brake means mounted on the stationary member for slowing linear movement of the moving member relative to the stationary member as the door is moved from an open to a closed position on the cabinet.

2. A braking mechanism according to claim 1 wherein the brake means is at least one brake pad mounted on the stationary member which frictionally engages the moving member during closing motion of the door.

3. A braking mechanism according to claim 2 where a brake pad is mounted on the stationary member at each side thereof for engaging each side of the moving member.

4. A braking mechanism according to claim 1 further comprising a dampening mechanism adapted to attach at one end to the top of the cabinet and at the opposite end to the stationary member, the dampening mechanism being between the slide mechanism and the top of the cabinet and being oriented so as to slow the movement of the door as it is moved from an open to a closed position on the cabinet.

5. A braking mechanism for a cabinet which has a top and a door which opens and closes from the top of the cabinet, the door having an interior side facing the cabinet comprising:

a hinge mechanism adapted to extend between the top of the cabinet and the door, the hinge mechanism comprising a hinge, a cabinet plate on one side of the hinge and a door plate on the opposite side of the hinge;

a slide mechanism adapted to attach to the underside of the door, the slide mechanism having a stationary member and a moving member, with the stationary member secured to the door plate; and a brake plate mounted on the stationary member for operative braking engagement with the moving member during the closing motion of the door.

6. A cabinet including side walls, a bottom wall and a top wall defining a front opening:

a door normally closing off said front opening defined by said side walls, said bottom wall and said top wall;

at least one hinge member secured to said top wall, said hinge member including a hinge, a plate secured to said top wall on one side of said hinge and an inner stationary track member on the other side of said hinge;

at least one outer movable track member secured to the back side of said door collinearly with said stationary track member on said hinge member;

a movable ball bearing carrying carriage interconnecting said inner stationary track member with its adjacent movable track member on said door, said door thereby being slidably movable from a position closing off said front opening to a position overlying said top wall; and at least one brake pad mounted on the stationary member which frictionally engages the moving member as the door is moved from an open to a closed position on the cabinet.

7. The cabinet of claim 6 further comprising a dampening unit interconnecting the hinge member and the stationary track member to slow the movement of the door during closing, the dampening mechanism extending between the stationary track member and hinge member.

8. A cabinet according to claim 7 including a spaced apart pair of hinge members, a pair of outer movable track members secured to said door and positioned collinearly with inner stationary track members on said hinge members, a pair of ball bearing carriages interconnecting each of said inner members with its adjacent moveable track member, and a pair of fluid containing damper units interconnecting their respective hinge members and stationary track members.

9. A cabinet according to claim 8 wherein the length of each said ball bearing carrying carriages is significantly greater than the length of its associated inner stationary track member.

10. The cabinet according to claim 9 wherein the inner stationary track members are shorter in length than either of their interconnected ball bearing carrying carriages or movable track members.

11. A cabinet according to claim 10 wherein the movable track members extend for substantially the full height of said door.

12. A cabinet according to claim 11 wherein means are associated with each of side walls to facilitate the mounting of said cabinet to a support wall.

13. A cabinet according to claim 7 wherein the dampening unit is a fluid containing cylinder.

14. An enclosure having a door which is slidably and rotatably retractable from a closed to an open position at the top of the enclosure comprising:

at least one ball bearing slide mechanism attached to the interior side of the door, the at least one ball bearing slide mechanism having a stationary member and a moving member;

a hinge member interconnecting the enclosure and the slide mechanism located adjacent the top of the enclosure;

a motion dampening mechanism extending between the slide mechanism and the top portion of the cabinet whereby the closing movement of the door is substantially slowed by the dampening mechanism as it hinges and slides downwardly and inwardly toward the enclosure; and brake means mounted on the stationary member for slowing linear movement of the moving member relative to the stationary member as the door is moved from an open to a closed position on the cabinet.

15. An enclosure according to claim 14 wherein the hinge member includes a hinge, a first plate connected to the hinge and attached to the enclosure adjacent the top thereof and a second plate connected to the hinge and attached to the stationary member on the slide mechanism.

16. An enclosure according to claim 15 wherein the dampening mechanism is attached to the first plate at one end and the second plate at its opposite end.

17. An enclosure according to claim 14 wherein the dampening mechanism is attached to the enclosure adjacent the top front thereof at one end and the stationary member on the slide mechanism at its opposite end.

18. An enclosure according to claim 17 wherein the dampening mechanism is a fluid containing cylinder.

19. An enclosure according to claim 18 wherein the dampening mechanism is a fluid containing piston and cylinder apparatus.

20. An enclosure according to claim 18 wherein the dampening mechanism is a non-cavitating damper cylinder.

* * * * *